US005766121A

United States Patent [19]

Spada

[11] Patent Number: 5,766,121

[45] Date of Patent: Jun. 16, 1998

[54] METHOD AND DEVICE FOR MAKING PACKETS FROM PACKAGING SHEETS, ESPECIALLY FOR CIGARETTES OR THE LIKE

[75] Inventor: Valter Spada, Marzabotto, Italy

[73] Assignee: Sasib S.p.A., Bologna, Italy

[21] Appl. No.: 647,738

[22] Filed: May 15, 1996

[30] Foreign Application Priority Data

Jun. 7, 1995 [IT] Italy ..... GE95 A 0064

[51] Int. Cl.[6] ..... B31B 1/62

[52] U.S. Cl. ..... 493/150; 493/132; 493/332; 493/333; 493/337; 427/288

[58] Field of Search ..... 493/53, 54, 60, 493/61, 62, 131, 132, 148, 150, 151, 186, 187, 188, 227, 264, 265, 267, 332, 333, 336, 337; 156/290, 291, 310; 427/208.2, 285, 288, 428

[56] References Cited

U.S. PATENT DOCUMENTS

| | | | |
|---|---|---|---|
| 2,237,346 | 4/1941 | Gilfillan | 156/291 |
| 2,776,224 | 1/1957 | Cote | 493/132 |
| 2,912,908 | 11/1959 | Crane et al. | 493/132 |
| 3,364,055 | 1/1968 | Nelson | 427/288 |
| 3,756,842 | 9/1973 | Meyers et al. | 427/208.2 |
| 3,802,325 | 4/1974 | Bardenhagen et al. | 493/148 |
| 3,878,771 | 4/1975 | Malcolm | 493/132 |
| 3,902,406 | 9/1975 | Reichert | 493/132 |
| 3,987,753 | 10/1976 | Seragnoli . | |
| 4,157,058 | 6/1979 | Vogel | 493/131 |
| 4,294,642 | 10/1981 | Focke et al. | 156/256 |
| 4,314,643 | 2/1982 | Forbes, Jr. | 206/626 |
| 4,487,596 | 12/1984 | Livens et al. | 493/125 |
| 4,514,181 | 4/1985 | Hughes | 493/131 |
| 4,608,038 | 8/1986 | Virta et al. | 493/29 |
| 4,708,704 | 11/1987 | Focke et al. | 493/151 |
| 4,715,847 | 12/1987 | Focke et al. | 493/60 |
| 4,742,955 | 5/1988 | Focke et al. | 229/123 |
| 4,838,846 | 6/1989 | Focke et al. | 493/132 |
| 4,843,798 | 7/1989 | Focke et al. | 493/169 |
| 4,865,679 | 9/1989 | Gamberini et al. . | |
| 4,949,841 | 8/1990 | Focke et al. | 206/254 |
| 5,053,254 | 10/1991 | Billeter | 427/208.2 |
| 5,092,516 | 3/1992 | Kastanek | 229/226 |
| 5,113,638 | 5/1992 | Focke et al. | 493/176 |
| 5,205,807 | 4/1993 | Adams, Jr. et al. | 493/175 |
| 5,385,526 | 1/1995 | Sigrist et al. | 493/151 |
| 5,462,223 | 10/1995 | Focke et al. | 427/288 |

FOREIGN PATENT DOCUMENTS

| | | |
|---|---|---|
| 453 547 | 12/1927 | Germany . |
| 1 217 842 | 5/1966 | Germany . |

*Primary Examiner*—Joseph J. Hail, III
*Assistant Examiner*—Darren Ark
*Attorney, Agent, or Firm*—Larson & Taylor

[57] ABSTRACT

A method and an apparatus for making packets from packaging sheets, especially for cigarettes or the like, which method involves folding or wrapping a preshaped packaging sheet (1), for example of paper or carton board, the packaging sheet (1) having parts (101, 101', 201, 201') for laying over each other, to at least one of which contact surfaces the adhesive is applied in order to fix the parts to each other. In order to fix the parts (101, 101', 201, 201') to each other a cold adhesive is used, that is an adhesive which is fluid at ambient temperature, whereas in order to hold said parts (101, 101', 201, 201') laid over each other in the formed condition of the packet, while the cold adhesive is drying, at least one spot of adhesive consisting of a hotmelt adhesive is applied to at least one of the opposing surfaces of at least one of the associated parts (101, 101', 201, 201') and in an area (17) not coinciding with the area (16) to which the cold adhesive is applied.

10 Claims, 4 Drawing Sheets

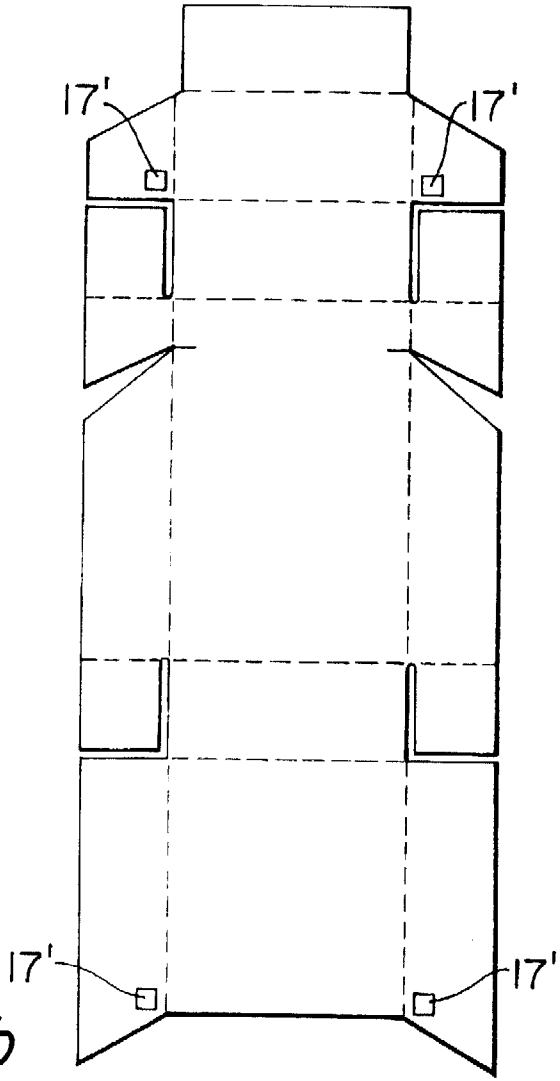
FIG. 5b
FIG. 5a
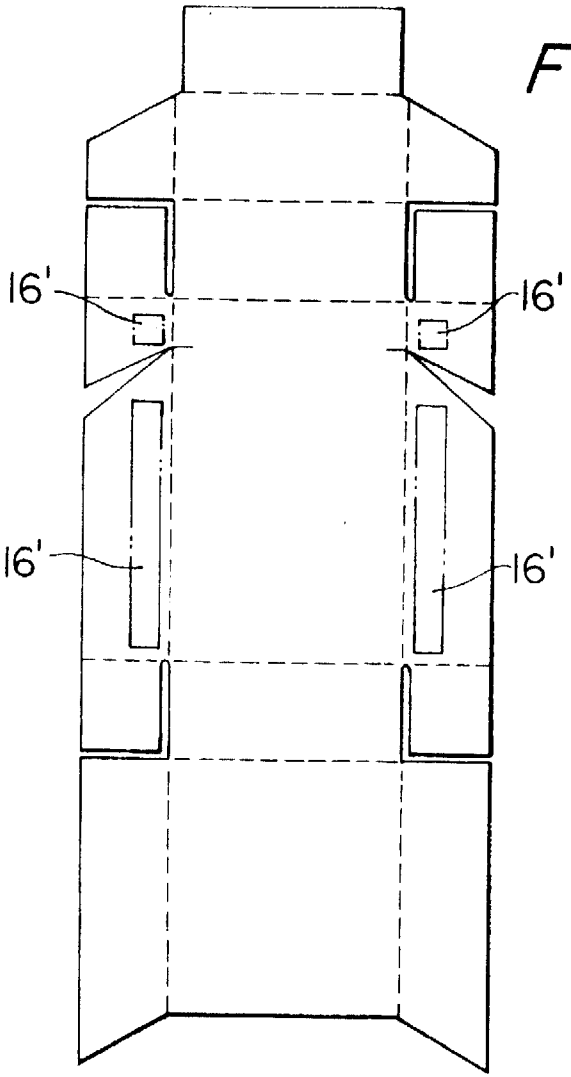

METHOD AND DEVICE FOR MAKING PACKETS FROM PACKAGING SHEETS, ESPECIALLY FOR CIGARETTES OR THE LIKE

FIELD OF THE INVENTION

The invention relates to a method and a device for making packets from packaging sheets, especially for cigarettes or the like, which method involves folding or wrapping a preshaped sheet of packaging material, for example a sheet of paper or a carton board blank, in such a way as to form a packet, the packaging sheet having tabs, margins or parts for laying over each other on at least some of the sides and adhesive being applied to at least one of the mutually contacting surfaces of said tabs, margins or parts in order to fix the tabs to each other.

The invention also relates to a device for carrying out the above method, which device comprises an adhesive applicator unit with means for conveying packaging sheets from an entrance to an exit through at least one adhesive applicator station, and means for discharging the packaging sheets from the adhesive applicator unit and for feeding them to a subsequent processing station, in particular a folding/forming station.

BACKGROUND OF THE INVENTION

At present, when making these kinds of packets, especially when making cigarette packets or the like, it is preferred to use so-called cold adhesives. These adhesives are fluid at ambient temperature and are applied at ambient temperature. They enable simpler applicator means to be used and at the same TIME also reduce the general soiling problems that arise when large amounts of hotmelt adhesive are used. Hotmelt adhesives have to be heated to make them fluid and at ambient temperature are in a basically solid or desiccated state. On the other hand, the use of cold adhesives, which need a longer time to dry and set, makes it necessary to provide some means for holding the packet in its finished shape until the adhesive has set sufficiently.

SUMMARY OF THE INVENTION

It is an object of the invention to provide a method and a device for making packets of the type described at the outset, with which it is possible to use cold adhesives without providing means for holding the finished packets in the folded condition until the cold adhesive has set, and this in a simple, inexpensive way that is easy to carry out.

The invention achieves the above objects with a method of the type described at the outset, in which in order to fix the tabs, margins or parts of the packaging sheet to each other, a cold adhesive is applied to at least one of the opposing surfaces of said tabs, margins or parts intended to be laid over each other and on a substantial part of said surface, while a hotmelt adhesive is applied to at least one of the opposing surfaces of at least one of the associated tabs, margins or parts, in an area not coinciding with the area to which the cold adhesive is applied, and of limited dimensions, in the form of a spot of adhesive, so as to hold down the margins, tabs or parts laid over each other in the finished position of the packet while the cold adhesive is drying. The cold adhesive is advantageously applied before the hotmelt adhesive is applied.

It is owing to the provision of spots of hotmelt adhesive to the parts of the packaging sheet laid over each other in the finished condition of the packet that said parts become fixed to each other provisionally within a very short period of time. What happens is that the hotmelt adhesive reaches its set condition within a short time, considerably less than that required by the cold adhesive, and so helps to hold the associated margins, tabs or the like of the packaging sheet folded against each other. This dispenses with the need for special means for holding the packet in its intended shape until the cold adhesive has set, and shortens the time required for the packet to pass from the folding/forming station to the subsequent processing stations, thus achieving both a structural simplification and a reduction in processing times.

According to a further improvement, in a cigarette-box, it is sufficent to provide warm glue spots only at two points of the box, in order to ensure that the box will be maintained in its form. Thus only four very small spots of warm glue are sufficent, two of them at the hinge lid and the other two at the box.

Particularly the spots of warm glue are arranged at the facing ends of the tabs which are intended to form the external layer of the long, narrow side walls of the box and of the hinge lid and which are laid over corresponding tabs forming the internal layer of said long, narrow side walls of the box and of the hinge lid.

In this way, it is possible to limit the extension of the areas of the hotmelt adhesive and also the quantity of the said adhesive, ensuring the advantages of the use of hotmelt adhesive and avoiding the risks of its use, or at least reducing said risks to a minimum.

A device according to the invention for carrying out the above method comprises an adhesive applicator unit containing a first cold-adhesive applicator station with means for applying cold adhesive and a subsequent hotmelt-adhesive applicator station with means for applying spots of hotmelt adhesive to respective non-coinciding areas of the tabs, margins or parts of the packaging sheet.

The invention also encompasses other features which further improve the above method and device and these form the subject of the below disclosure.

BRIEF DESCRIPTION OF THE DRAWINGS

The particular features of the invention and the advantages it provides will be shown in greater detail in the description of a preferred embodiment illustrated by way of a non-restricting example in the accompanying drawings, in which:

FIGS. 5*a* and 5*b* schematically depict respective faces of an alternative blank where adhesive is applied instead to the mating areas of those areas of the blank depicted in FIGS. 4*a* and 4*b*.

DESCRIPTION OF THE PREFERRED EMBODIMENTS

Figure 1:
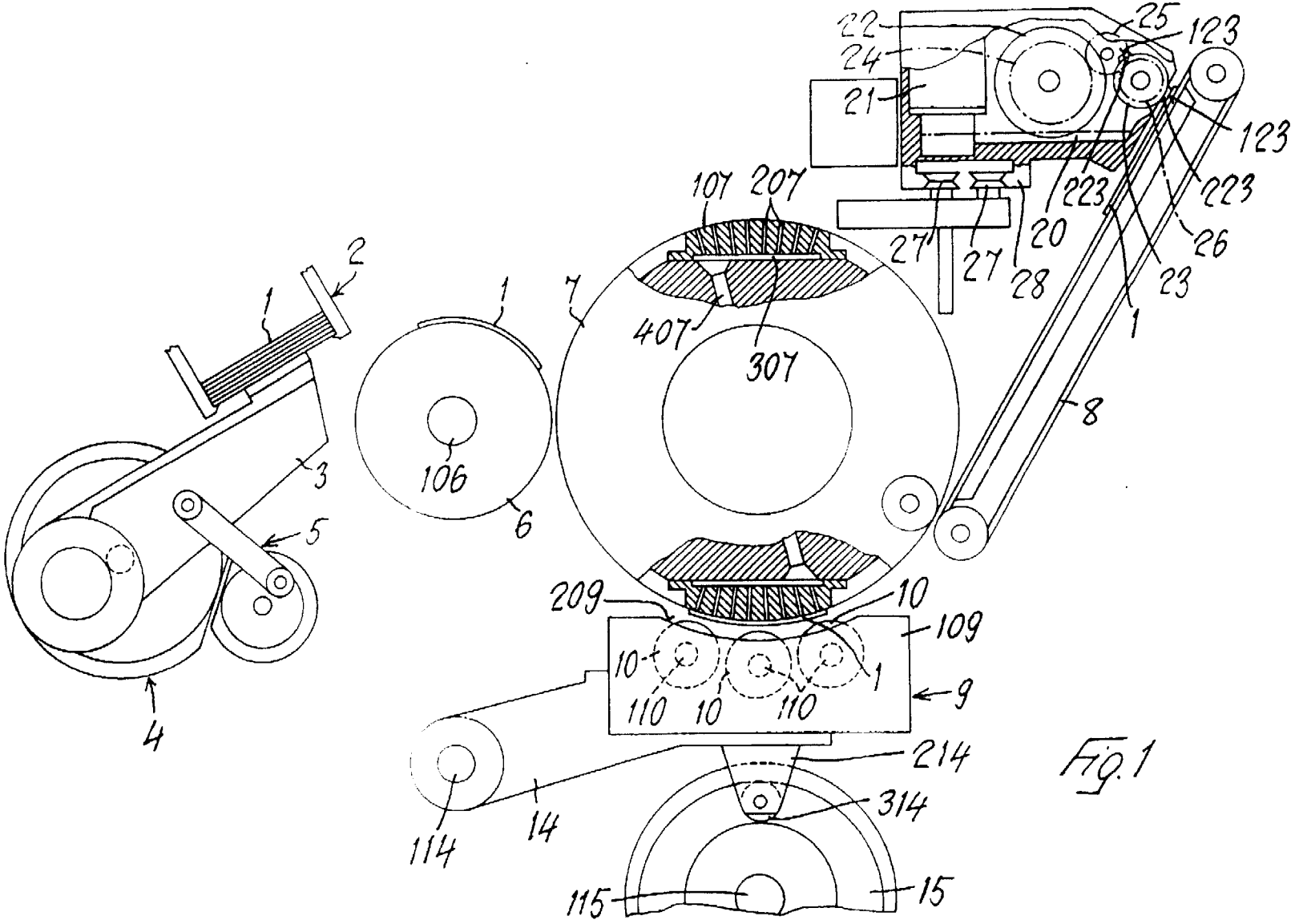
FIG. 1 is a schematic front view, partly in section, of the device according to the invention.

With reference to the figures, a device for making packets from packaging sheets, in particular from preshaped sheets of carton board, which are folded to form a packet and have tabs, margins or parts designed to be laid over each other and fixed together by adhesive means, comprises a unit for applying adhesive to the mutually contacting sides of at least one of said associated margins, tabs or parts of the packaging sheet 1. An example of such a blank, illustrated in FIG. 3, includes a front panel 400, a bottom panel 500, a back panel 100, a lid top panel 200, and a lid front panel 300. This blank 1 is suitably shaped for making a rectangular parallelepipedal pack and it will be appreciated that for convenience both faces of blank 1 are depicted with primes (') being used to signify when a reverse face of the noted tabs is the operative face (as discussed subsequently). Thus, blank 1 has back side tabs 101, front side tabs 101', lid back side tabs 201, lid front side tabs 201' intended to be fixed together by being laid over each other in the folded condition of the blank 1 and intended to form together the long, narrow sides of the pack and of an associated flip-up lid hinged along the back of the pack as well known in the art.

The blanks 1 are stacked and placed in a magazine 2 and are fed by a suction arm 3 moved by a system of cranks 4 and guide levers 5 to a suction drum 6 at the entrance of the adhesive applicator unit. The suction arm 3 executes a transverse movement relative to its length to withdraw one blank 1 from the bottom of the stack in the magazine 2 and in combination a forward and backward movement in its longitudinal direction, thereby presenting the collected blank 1 tangentially to the entrance suction drum 6. The entrance suction drum 6 is turned about its axis on an end-supported shaft 106 and operates in combination with a second or conveying suction drum 7 which is directly adjacent to it, virtually tangential but separated by a short distance. The conveying suction drum 7 takes the blank from the entrance drum 6 and feeds it into a station where cold adhesive is applied. In particular, the conveying drum 7 has at least one suction segment 107, preferably two diametrically opposite suction segments, possibly also more suction segments distributed around its periphery; and it is caused to rotate about its axis.

Each suction segment 107 substantially corresponds in area to the area of the blank 1. The suction segments comprise approximately radial channels 207, preferably arranged in a fan shape, which communicate with a low-pressure chamber 307 connected via a duct 407 to a generator of low and high pressure alternately. A pressure generator is advantageously used, the duct 407 being connected alternately to said generator and to atmospheric pressure by a rotary valve in accordance with the angular position of the suction segment 107. Thus, when it is picking up the blank 1 and when it is in the adhesive applicator station, the suction segment 107 is connected to the low-pressure generator, whereas when it is in the discharge station it is connected to atmospheric pressure. In the pick-up station the blank is surrendered by the conveying drum 7 to a discharging conveyor 8, for example by a belt or pair of belts with suction action.

At the cold-adhesive applicator station, the suction segment 107 is situated directly above the cold-adhesive applicator means.

In the example illustrated, these means comprise an open-topped cold-adhesive tank 9 of which the open top is towards the conveying drum 7, that is towards the suction segment 107 which is temporarily at the cold-adhesive applicator station. The tank 9 extends below the entire area of the blank 1 in both the circumferential and axial directions of the conveying drum and the tank walls 109 oriented transversely to the axis of the conveying drum 7 comprise a concavity 209 coaxial with this conveying drum 7. Mounted in these walls are one or more shafts 110 for a plurality of rollers 10 for picking up and applying the cold adhesive. The shafts 110 lie alongside each other and their centers are positioned on an ideal circular line coaxial with the conveying drum 7, that is with the recesses 209. The rollers 10 and shafts 110 correspond in position with the desired areas of application of the cold adhesive and all dimensions are such that the rollers 10 are at least partially immersed in the cold adhesive on the side away from the conveying drum 7, while the part facing said conveying drum 7 is out of the cold adhesive.

The tank 9 together with the cold-adhesive pickup/applicator rollers 10 is mounted on the free end of an arm 14 which at its other end is hinged at axle 114 in such a way as to be able to pivot freely about an axis parallel with the axis of the drum. The arm 14 includes a downward transverse extension 214 fitted with at least one roller 314 that turns on an axis parallel with the axis of the conveying drum 7 and that runs in a circular cam track 15 which is supported so as to rotate about an eccentric axis 115. The eccentric axis is vertically lower than the axis of the circular cam track 15 in order that the rotation of the cam will cause the tank 9 alternately to rise, bringing the rollers 10 into contact with the conveying drum 7, or rather with the blank 1, and then cause it to descend to a position substantially radially distant from said blank 1. The rotary actuation of the cam 15 and the rotary actuation of the cold-adhesive applicator rollers 10 are synchronized with the feeding of the blanks 1 into the cold-adhesive applicator station, in other words with the advancing steps of the entrance drum 6 and with those of the conveying drum 7. In this way, when a new blank 1 is being fed into the cold-adhesive applicator station and when it is being passed on to the subsequent discharge station, the tank 9 and the adhesive pick-up/applicator rollers 10 are held away from the blank 1, whereas when the conveying drum 7 is in its pause phase, the tank 9 with the rollers 7 moves towards it, bringing the rollers 10 into contact with the blank, and then withdraws. The rollers 10 always present to the new blank 1 in the cold-adhesive applicator station a portion of their adhesive-carrying surface that has not yet come into contact with any blank and has therefore not yet deposited the adhesive distributed on itself. The adhesive is thereby transferred to the desired areas of the blank 1 in a touching or punching movement.

Figure 3:
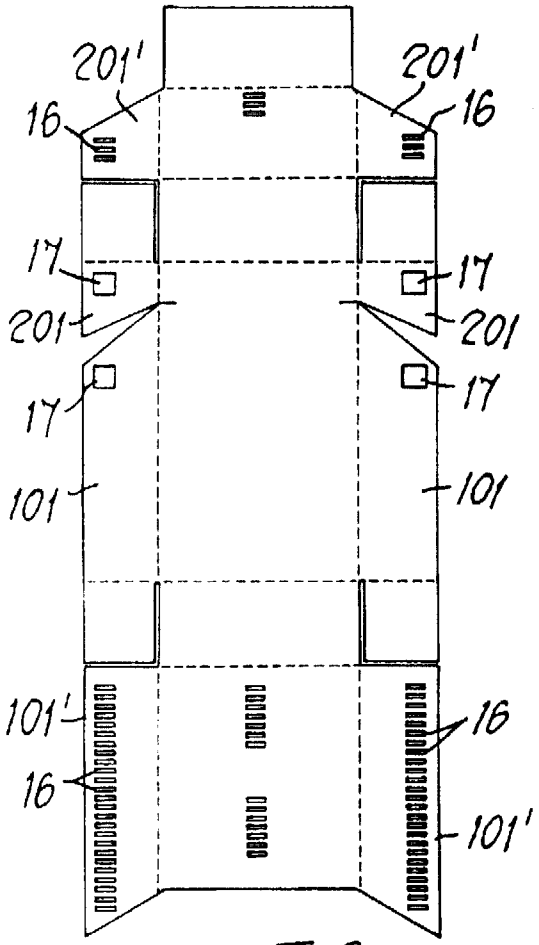
FIG. 3 is a plan view of the blank with the spots of applied hotmelt adhesive and with the areas of applied cold adhesive.
Figure 4B:
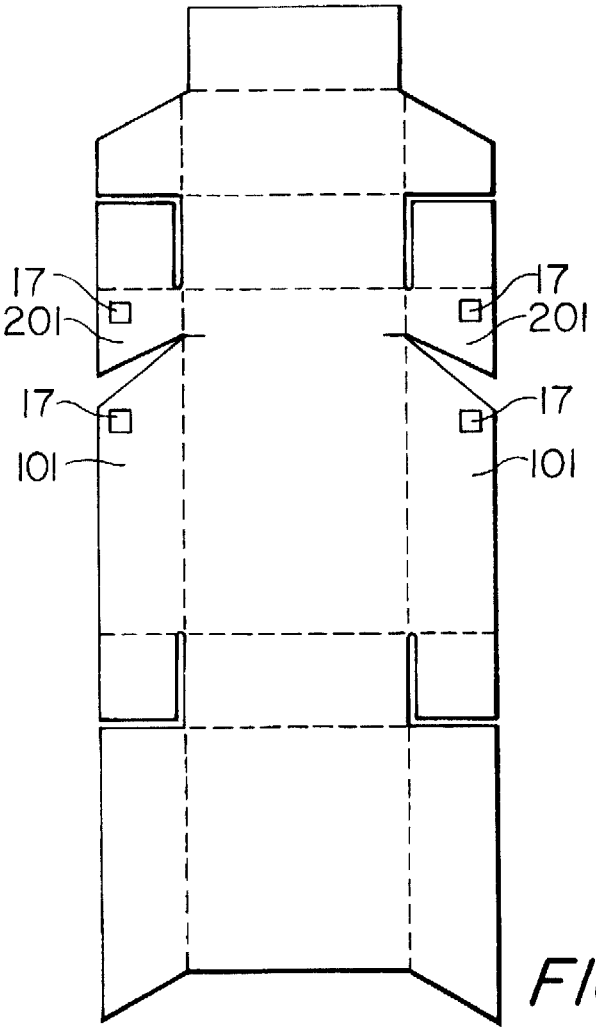
FIGS. 4*a* and 4*b* schematically depict respective faces of the blank depicted in FIG. 3.
Figure 4A:
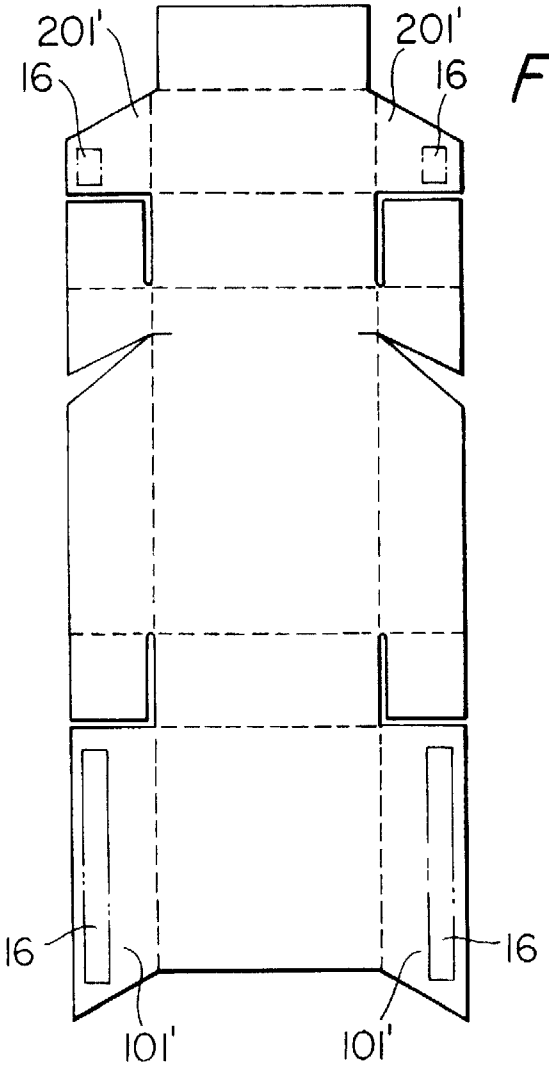

With reference to FIGS. 3 and 4*a*, each roller 10 is designed to produce a print 16 of cold adhesive on a predetermined part of the blank 1—in the present case on the tabs 101' and 201' in particular, and in certain intermediate areas 301' and 401. These prints must have predetermined dimensions and a predetermined quantity of adhesive to avoid soiling. The blank 1 is advantageously conveyed through the cold-adhesive applicator station with a transverse orientation, preferably perpendicular to the longitudinal line of the prints of cold adhesive, that is to say in this case with the longitudinal axis of the blank 1 parallel with the axis of the conveying drum 7. When the box is in its formed condition, that is when the blank 1 is folded, other associated tabs or parts of the blank 1 marked 101 and 201 are laid over said areas 101' and 201' and said parts must be held against the tabs 101' and 201' until the cold adhesive has set sufficiently to prevent the associated superimposed parts from separating.

In order to hold said tabs 101, 101' and 201, 201'together for long enough to ensure that the cold adhesive has dried, downstream of the cold-adhesive applicator station and before the subsequent processing unit, that is before the blank leaves the adhesive applicator unit, there is a station where spots of hotmelt adhesive are applied to the tabs 101, 201 as shown in FIGS. 3 and 4*b*. The spots of hotmelt adhesive 17 are advantageously applied to the tab 101, 201 associated with that to which the cold adhesive has been applied, in a position that will not coincide with the prints of cold adhesive 16 once the associated tabs 101, 101' and 201, 201' are brought into contact with each other.

FIGS. 5*a* and 5*b* schematically depict an alternative application of cold adhesive prints 16' and hotmelt adhesive spots 17' at positions complementary to prints 16 and spots 17.

Figure 2:
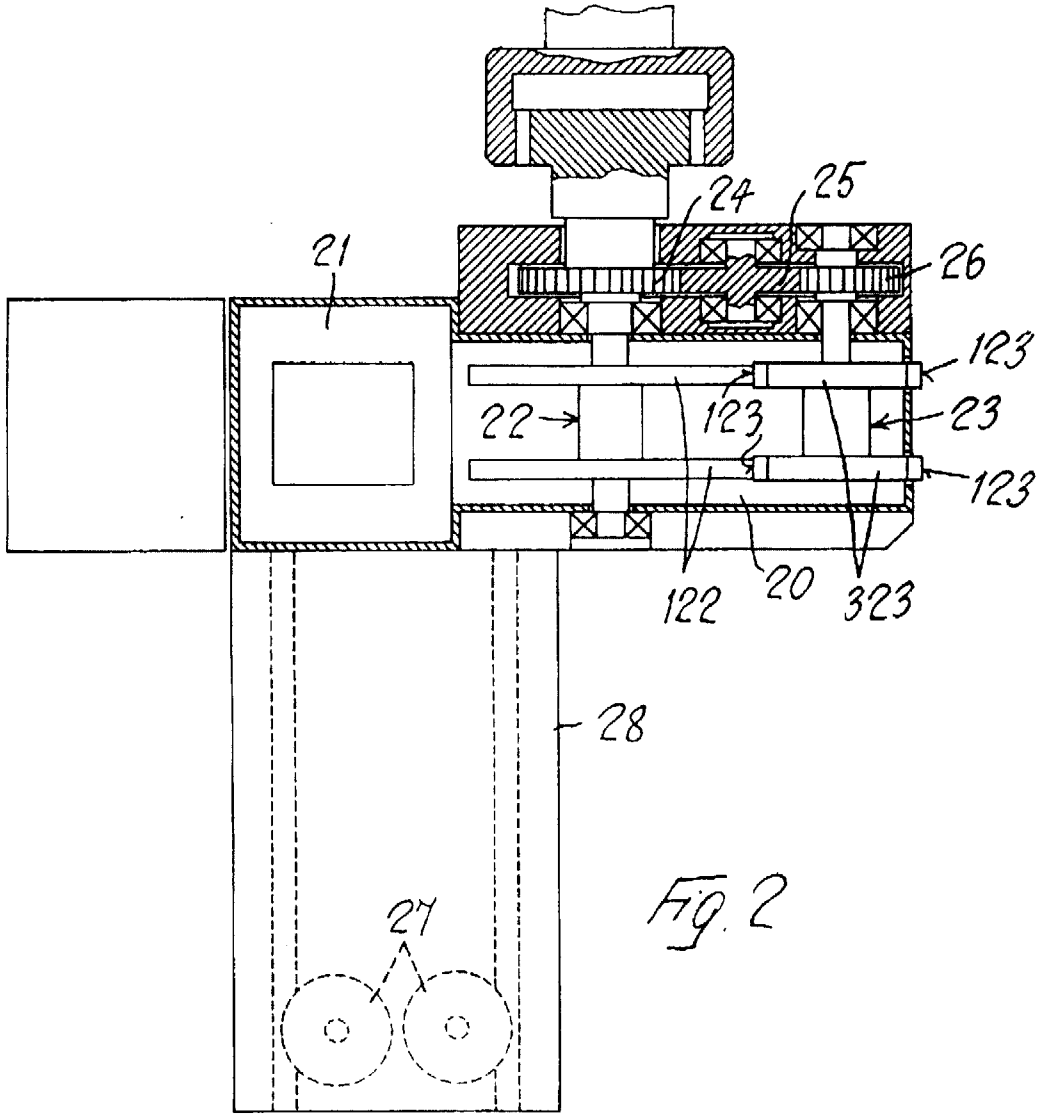
FIG. 2 is an enlarged plan view from above and partly in section of the device for applying the spots of hotmelt adhesive.

With reference to FIGS. 1 and 2, the hotmelt-adhesive applicator device comprises a tank 20 of hotmelt adhesive fitted with heating means, for example electrical resistors or the like, indicated globally by the numeral 21. Partly immersed in the hotmelt adhesive at the bottom of the tank 20 is a first pick-up roller 22 which is caused to rotate in synchronism with the advance of the blanks 1. An applicator roller 23 is supported in such a way as to be able to turn about an axis parallel with that of the pick-up roller 22 and comprises, distributed at equal angular intervals around its circumference, a plurality of pads 123 for picking up and applying the hotmelt adhesive: these are carried in a radially projecting position on the roller 23 and are oriented in the circumferential direction of the roller 23. The pads 123 consist preferably of coaxial circular arcs tangential to the peripheral surface of the pick-up roller 22. More particularly, said surfaces forming the pads 123 consist of the radially outermost surfaces of frustoconical teeth 223 situated at equal angular intervals around the hotmelt-adhesive applicator roller 23. The pick-up roller 22 and the applicator roller 23 are connected dynamically to each other by a train of gears 24, 25, 26 and are caused to rotate by the same motor or driven shaft.

With reference to the blank 1 for making hard cigarette packs with hinged lids, shown in FIG. 3, the spots of hotmelt adhesive 17 on the same side of the blank 1 are applied in line with each other in the longitudinal direction of the blank, that is transversely to the direction of advance of the blank 1, each at the adjacent ends of the tabs 101, 201 which are intended to form the internal sides of the long, narrow sides of the pack and are intended to be laid over the internal side of the associated tabs 101', 201'. The spots of hotmelt adhesive and the areas of cold adhesive must therefore be applied to the opposing sides of the associated tabs 101, 101' and 201, 201', so that the cold adhesive and hotmelt adhesive are applied to the opposite faces of the blank 1 in its unfolded condition. Furthermore the particular arrangement of the spots of hotmelt adhesive 17 enables them to be applied simultaneously for the tabs 101, 201 on the same side of the blank 1. If this is done, both the pick-up roller 22 and the applicator roller 23 are composed of two discs 122, 323 separated axially from each other by a distance equal to that between the spots of hotmelt adhesive 17 on the tabs 101 and 201. Each disc 323 of the applicator roller 23 has two frustoconical teeth 223 separated angularly from each other to produce spots of hotmelt adhesive 17 on the tabs 101, 201 on the two sides of the blank 1 as it passes through, that is on the forward side and on the rear side, with reference to the direction of advance, while the teeth 223 of the two discs 323 are axially in line with each other.

With reference to FIG. 1, the device for applying the spots of hotmelt adhesive, i.e. the applicator station for the spots of hotmelt adhesive, is advantageously located at the exit end of the blank-discharging conveyor 8 of the adhesive applicator unit. This cuts down the time taken by the blanks to reach the immediately subsequent folding station, thereby enabling the blanks to be folded and hence the tabs 101, 101', 201, 201' to be laid over each other before the hotmelt adhesive has dried. After folding has been completed, the hotmelt adhesive dries much faster than the cold adhesive, which means that the spots of hotmelt adhesive temporarily hold the pack in the formed condition, that is with the tabs 101, 101' and 201, 201' bonded together, until the cold adhesive has set, without requiring the use of mechanical or other such folding means.

Due to their position only the four very small spots of hotmelt adhesive are sufficent to ensure the effect of holding the pack in the formed condition during the period necessary for the cold glue to become dry. For each tab 101 and 201, of the box and of the hinge lid, only one small spot 17 of hot-melt adhesive is sufficent. In this way the quantity of hotmelt adhesive used is very small and it is possible to ensure the maintenance of the form of the pack, while the disadvantages of the hotmelt adhesive are avoided or reduced to a very low degree.

In another improvement, which not only enables the positions of the spots of hotmelt adhesive 17 on the blank 1 to be perfectly situated and adjusted, but also enables a plurality of spots of hotmelt adhesive to be produced in various positions along the longitudinal axis of the blank 1, that is along an axis transverse to the direction of advance of the blanks, the hotmelt-adhesive applicator device is mounted on a slide 27 which can be moved along tracks 28.

The invention is not of course limited to the embodiments described above and illustrated and can be greatly altered and modified, especially from the point of view of construction. Thus, the construction of the devices for applying the cold adhesive and the spots of hotmelt adhesive depends on the geometry and shapes chosen for the packet and hence for the blank. All of this is possible without departing from the underlying principle set forth above and claimed below.

I claim:

1. A method of applying adhesive to a longitudinal packaging sheet which is subsequently made into a packet with a hinged lid, the longitudinal packaging sheet having a first surface and an opposite second surface which packaging sheet is suitably folded and glued to make the packet using a hotmelt adhesive to initially hold parts of the folded packaging sheet together while those parts are securely glued together with a cold adhesive, said method comprising the steps of:

providing the packaging sheet with a front panel, a bottom panel connected longitudinally to the front panel, a back panel connected longitudinally to the bottom panel, a lid top panel connected longitudinally to the back panel, and a lid front panel connected longitudinally to the lid top panel, respective front side tabs provided on each respective lateral side of the front panel, respective back side tabs provided on each respective lateral side of the back panel adjacent the bottom panel, respective lid back side tabs provided on each respective lateral side of the back panel adjacent the lid top panel, and respective lid front side tabs provided on each respective lateral side of the lid front panel;

applying a cold adhesive to the first surface at selected portions of the front side tabs and of the lid front side tabs; and applying a hotmelt adhesive to the second surface at selected areas of the back side tabs and of the lid back side tabs, whereby when the packaging sheet is folded to form the packet, (a) the respective front side tabs and back side tabs overlap in adhesive contact to form respective sides of the packet with the first surfaces of the respective front side tabs facing the second surfaces of the back side tabs but with the selected portions separated from the selected areas, and (b) the respective lid front side tabs and lid back side tabs overlap in adhesive contact to form respective sides of the hinged lid of the packet with the first surfaces of the respective lid front side tabs facing the second surfaces of the lid back side tabs but with the selected portions separated from the selected areas.

2. A method of making a packet as claimed in claim 1:

wherein said cold adhesive applying step includes the step of depositing the cold adhesive as a strip along a laterally outer section of each of the front side tabs and each of the lid front side tabs; and wherein said hotmelt adhesive applying step includes the step of depositing the hotmelt adhesive in each selected area as a single spot along a laterally outer section of each of the back side tabs and each of the lid back side tabs.

3. A method of making a packet as claimed in claim 2: wherein said hotmelt adhesive applying step further includes the depositing of the spot of each back side tab in the selected area which is adjacent an end distal from the bottom panel.

4. A method of making a packet as claimed in claim 3: wherein said hotmelt adhesive applying step is performed after said cold adhesive applying step.

5. A method of making a packet as claimed in claim 4:

wherein said applying of the cold adhesive step includes the steps of (a) conveying the packaging sheet in a direction perpendicular to a longitudinal axis thereof through a cold adhesive applicator, and (b) applying the strips of the cold adhesive to the front side tabs and the lid front side tabs with the cold adhesive applicator at the same time; and wherein said applying of the hotmelt adhesive includes the steps of (a) conveying the packaging sheet in a direction perpendicular to a longitudinal axis thereof through a hotmelt adhesive applicator, and (b) sequentially applying the spots of the hotmelt adhesive to one and then the other of the selected areas of the back side tabs and the lid back side tabs with the hotmelt adhesive applicator with the spots on each lateral side of the packaging sheet being applied at the same time.

6. A method of applying adhesive to a longitudinal packaging sheet which is subsequently made into a packet with a hinged lid, the longitudinal packaging sheet having a first surface and an opposite second surface which packaging sheet is suitably folded and glued to make the packet using a hotmelt adhesive to initially hold parts of the folded packaging sheet together while those parts are securely glued together with a cold adhesive, said method comprising the steps of:

providing the packaging sheet with a front panel, a bottom panel connected longitudinally to the front panel, a back panel connected longitudinally to the bottom panel, a lid top panel connected longitudinally to the back panel, and a lid front panel connected longitudinally to the lid top panel, respective front side tabs provided on each respective lateral side of the front is panel, respective back side tabs provided on each respective lateral side of the back panel adjacent the bottom panel, respective lid back side tabs provided on each respective lateral side of the back panel adjacent the lid top panel, and respective lid front side tabs provided on each respective lateral side of the lid front panel;

applying a cold adhesive to the first surface at selected portions of the back side tabs and of the lid back side tabs; and applying a hotmelt adhesive to the second surface at selected areas of the front side tabs and of the lid front side tabs, whereby when the packaging sheet is folded to form the packet, (a) the respective back side tabs and front side tabs overlap in adhesive contact to form respective sides of the packet with the first surfaces of the respective back side tabs facing the second surfaces of the front side tabs but with the selected portions separated from the selected areas, and (b) the respective lid back side tabs and lid front side tabs overlap in adhesive contact to form respective sides of the hinged lid of the packet with the first surfaces of the respective lid back side tabs facing the second surfaces of the lid front side tabs but with the selected portions separated from the selected areas.

7. A method of making a packet as claimed in claim 6:

wherein said cold adhesive applying step includes the step of depositing the cold adhesive as a strip along a laterally inner section of each of the back side tabs and each of the lid back side tabs; and wherein said hotmelt adhesive applying step includes the step of depositing the hotmelt adhesive in each selected area as a single spot along a laterally inner section of each of the front side tabs and each of the lid front side tabs.

8. A method of making a packet as claimed in claim 7: wherein said hotmelt adhesive applying step further includes the depositing of the spot of each front side tab in the selected area which is adjacent an end distal from the bottom panel.

9. A method of making a packet as claimed in claim 8: wherein said hotmelt adhesive applying step is performed after said cold adhesive applying step.

10. A method of making a packet as claimed in claim 9:

wherein said applying of the cold adhesive step includes the steps of (a) conveying the packaging sheet in a direction perpendicular to a longitudinal axis thereof through a cold adhesive applicator, and (b) applying the strips of the cold adhesive to the back side tabs and the lid back side tabs with the cold adhesive applicator at the same time; and wherein said applying of the hotmelt adhesive includes the steps of (a) conveying the packaging sheet in a direction perpendicular to a longitudinal axis thereof through a hotmelt adhesive applicator, and (b) sequentially applying the spots of the hotmelt adhesive to one and then the other of the selected areas of the front side tabs and the lid front side tabs with the hotmelt adhesive applicator with the spots on each lateral side of the packaging sheet being applied at the same time.

* * * * *